US012253088B2

(12) United States Patent
Jukes

(10) Patent No.: US 12,253,088 B2
(45) Date of Patent: Mar. 18, 2025

(54) FAN

(71) Applicant: Dyson Technology Limited, Wiltshire (GB)

(72) Inventor: Timothy Neil Jukes, Swindon (GB)

(73) Assignee: Dyson Technology Limited, Wiltshire (GB)

( * ) Notice: Subject to any disclaimer, the term of this patent is extended or adjusted under 35 U.S.C. 154(b) by 0 days.

(21) Appl. No.: 18/020,685

(22) PCT Filed: Aug. 12, 2021

(86) PCT No.: PCT/GB2021/052091
§ 371 (c)(1),
(2) Date: Feb. 10, 2023

(87) PCT Pub. No.: WO2022/034327
PCT Pub. Date: Feb. 17, 2022

(65) Prior Publication Data

US 2024/0011494 A1 Jan. 11, 2024

(30) Foreign Application Priority Data

Aug. 14, 2020 (GB) ..... 2012721

(51) Int. Cl.
*F04D 25/10* (2006.01)
*F04D 19/00* (2006.01)
*F04D 29/56* (2006.01)

(52) U.S. Cl.
CPC ..... *F04D 19/002* (2013.01); *F04D 25/10* (2013.01); *F04D 29/563* (2013.01)

(58) Field of Classification Search
CPC ..... F04D 19/002; F04D 25/10; F04D 29/563
See application file for complete search history.

(56) References Cited

U.S. PATENT DOCUMENTS

2015/0335127 A1* 11/2015 Teramoto ..... A45D 20/10 34/97

FOREIGN PATENT DOCUMENTS

| | | | |
|---|---|---|---|
| CA | 2500756 | A1 | 9/2006 |
| CN | 108592367 | A | 9/2018 |
| CN | 210373772 | U | 4/2020 |
| CN | 211177095 | U | 8/2020 |
| JP | 06-209818 | A | 8/1994 |
| JP | 2016-035359 | A | 3/2016 |
| JP | 2018-204889 | A | 12/2018 |
| RU | 2603234 | C1 | 11/2016 |
| WO | 2022/034327 | A1 | 2/2022 |

OTHER PUBLICATIONS

International Search Report and Written Opinion received for PCT Patent Application No. PCT/GB2021/052091, mailed on Nov. 11, 2021, 14 pages.

(Continued)

*Primary Examiner* — Aaron R Eastman
(74) *Attorney, Agent, or Firm* — Tucker Ellis LLP; Michael G. Craig

(57) ABSTRACT

Disclosed is a fan including a nozzle having an air outlet through which an airflow is expelled in an axial direction. The fan includes an axial perturbation device for applying a velocity perturbation at a first frequency to the airflow in the axial direction.

18 Claims, 5 Drawing Sheets

(56) References Cited

OTHER PUBLICATIONS

Office Action received for GB Application No. 2012721.3, mailed on Jan. 18, 2021, 3 pages.
Search Report received for GB Application No. 2012721.3, mailed on Jan. 15, 2021, 1 page.
Examination Report received for GB Application No. 2012721.3, mailed on Oct. 21, 2022, 3 pages.

* cited by examiner

FAN

CROSS-REFERENCE TO PRIOR APPLICATION

This application is a § 371 National Stage Application of PCT International Application No. PCT/GB2021/052091 filed Aug. 12, 2021, which claims the priority of United Kingdom Application No. 2012721.3, filed Aug. 14, 2020, each of which are herein incorporated by reference in their entirety.

TECHNICAL FIELD

The present invention relates to a fan and in particular a room or desk fan.

BACKGROUND

It is known to provide fans having relatively large diameter nozzles that expel correspondingly larger diameter jets. This may be desirable, for example, to provide air to a greater volume of a room, or to provide air to a larger area of a user's head and/or body. In practice, design constraints such as fan size or aesthetic considerations are often limiting factors in the nozzle size of a fan, such as a room or a desk fan.

SUMMARY

The present invention provides a fan comprising a nozzle having an air outlet through which an airflow is expelled in an axial direction; and an axial perturbation device for applying a velocity perturbation at a first frequency to the airflow in the axial direction.

As a result, the perturbation device may cause a series of toroidal vortices to be generated at the air outlet at the first frequency. The vortices may be aligned in the axial direction. The series of vortices may cause the jet to spread radially with respect to the axial direction. That is, perturbing the velocity of the jet in the axial direction may increase a diameter of the jet downstream of the outlet for a given diameter of the nozzle. This may improve the versatility of a fan having a nozzle with a fixed shape and/or diameter.

The first frequency may be selected to correspond to a natural frequency of toroidal vortex modes in the jet. This may be to cause an amplification of the toroidal vortex modes, thereby to form coherent toroidal vortices on the scale of the nozzle or jet diameter.

Optionally, the fan is operable: in a first mode of operation in which the axial perturbation device is inactive; and in a second mode of operation in which the axial perturbation device is active and applies a velocity perturbation to the airflow at the first frequency.

In this way, the fan may be operated in a first mode of operation wherein a jet of air is expelled from the nozzle without perturbing the airflow, which may reduce an entrainment of ambient air into the jet. This may be advantageous where the air is conditioned air, such as purified air. The fan may also be operated in a second mode of operation wherein the airflow is perturbed in the axial direction to increase a diameter of the jet downstream from the nozzle, for example to expel air towards a larger area of a user's face or body.

Optionally, the fan comprises a radial perturbation device for applying a velocity perturbation at a second frequency to the airflow in a plane orthogonal to the axial direction.

For example, the radial perturbation device may apply a velocity perturbation at the second frequency in a radial direction orthogonal to the axial direction, and/or helically around an axis aligned with the axial direction. This may cause successive toroidal vortices in the series of toroidal vortices to be radially displaced relative to one another. As a result, the airflow in the jet may be entrained by the radially displaced toroidal vortices and the jet may spread, or split in the one or more radial directions, or the jet may bloom and spread in all directions. In this way, the fan may provide variable airflow characteristics, such as differently shaped jets, from a single nozzle.

Optionally, a ratio of the first frequency to the second frequency is greater than 1. The ratio of the first frequency to the second frequency may be at least 2. This may be to permit a spreading or splitting of the jet in at least one radial direction, for example to cause the jet to bifurcate in a bifurcation plane that is aligned with the axial direction.

Optionally, a ratio of the first frequency to the second frequency is no greater than 4. This may be to permit a spreading or a splitting of the jet in more than one plane that is parallel to the axial direction. This may limit the range of the first and/or the second frequency.

Optionally, the fan is operable: in a first mode of operation in which the axial and radial perturbation devices are inactive; in a second mode of operation in which the axial perturbation device is active and applies a velocity perturbation to the airflow at the first frequency, and the radial perturbation device is inactive; and in a third mode operation in which the axial perturbation device is active and applies a velocity perturbation to the airflow at the first frequency, and the radial perturbation device is active and applies a velocity perturbation to the airflow at the second frequency.

In this way, the axial and radial perturbation devices may cooperate to cause a change in the behaviour of the jet, for example to cause the jet to split or spread in one or more directions.

Optionally, the fan is operable in a fourth mode of operation in which the radial perturbation device applies a velocity perturbation to the airflow at a third frequency, and the third frequency is different to the second frequency.

In this way, in the fourth mode of operation, the jet may behave differently to the jet in the third mode of operation, for example to improve the versatility of the fan.

Optionally, the second frequency and the third frequency are chosen such that the airflow expelled from the nozzle bifurcates in the third mode of operation and blooms in the fourth mode of operation.

In the third mode of operation, the first frequency may be, or may be sufficiently close to, an integer multiple of the second frequency, for example, double or triple the second frequency. In this way, each of the toroidal vortices generated may follow the path of another that was generated previously. That is, the vortices may be displaced in a regular, repeating pattern around an axis aligned with the axial direction, which may cause the jet to split, or spread, in one or more radial directions.

In the fourth mode of operation, the frequency may be selected such that successively generated toroidal vortices are displaced in an irregular pattern around an axis aligned with the axial direction. That is, one vortex may not exactly follow another vortex generated previously. In this way, the toroidal vortices may interact to cause the jet to bloom and spread in multiple radial directions, which may be arbitrary radial directions.

Optionally, a ratio of the first frequency to the second frequency is about 2.0, and a ratio of the first frequency to the third frequency is about 2.5.

That is, the first frequency may be double the second frequency to cause successively generated vortices to be alternately displaced on opposite sides of the axis in a plane parallel to the axis. This may form a radially staggered series of toroidal vortices in the plane downstream from the nozzle. The vortices may be displaced in one or more radial directions, depending on the first and second frequencies. As a result, the airflow in the jet may be entrained by the radially displaced toroidal vortices, causing the jet to spread in the one or more radial directions. The jet may split, or bifurcate, into two or more jets.

In this way, in the third mode of operation, the fan may provide a split or spread jet from a single nozzle. The jet expelled from the nozzle in the third mode of operation may be directed towards two or more users at once or may be spread in a vertical direction to improve coverage of a user's body, for instance.

In the fourth mode of operation, the jet may bloom, or spread in multiple radial directions. This may provide a more diffuse airflow to a room. The effect may be achieved in the absence of any baffle or other such device. The blooming jet may increase entrainment and mixing of ambient air, which may be advantageous when conditioned air is to be supplied to a room.

Optionally, the radial perturbation device comprises an actuator configured to oscillate the air outlet at the second frequency.

The actuator may be mechanically and/or magnetically coupled to at least a part of the nozzle, such as the nozzle tip. The actuator may be any suitable actuator, such as an electromechanical, electromagnetic, hydraulic or pneumatic actuator. For example, the radial perturbation device may comprise one or more actuators for imparting a linear motion in a respective one or more radial directions. In this way, the nozzle may be oscillated in a linear, elliptical or circular motion by the one or more actuators. Optionally, the actuator may comprise a motor and a linkage, or a suitable gear system, for causing circular motion of the air outlet.

Alternatively, the radial perturbation device may be an acoustic perturbation device, for example comprising one or more acoustic devices such as loudspeakers disposed circumferentially around the air outlet. Adjacent acoustic devices may be operated in sequence at the second frequency to apply a helical velocity perturbation to the airflow expelled from the nozzle. Optionally, opposing acoustic devices disposed at either side of the air outlet may be operated sequentially at the second frequency to impart a radial velocity perturbation to the airflow expelled from the nozzle.

Optionally, the actuator oscillates the air outlet with a peak-to-peak amplitude of greater than 1% of the nozzle diameter The nozzle diameter may be a diameter of the air outlet. The actuator may oscillate the air outlet with a peak-to-peak amplitude of between 1% and 10% of the nozzle diameter, or equal to or greater than 10% of the nozzle diameter. The actuator may oscillate the air outlet with a peak-to-peak amplitude of between 3% and 7% of the nozzle diameter, such as 5% of the nozzle diameter. For example, the radial perturbation device may displace the air outlet by between 2 mm and 6 mm, such as between 3 mm and 5 mm, such as 4 mm when the nozzle diameter is around 92 mm.

Optionally, the axial perturbation device is an acoustic perturbation device.

In this way, the fan may comprise fewer moving parts. The acoustic perturbation device may be controlled electronically, which may improve control of the frequency and/or the amplitude of the perturbations.

Alternatively, or in addition, the axial perturbation device may comprise a mechanical or electromechanical part such as a movable paddle, a flow restrictor, or flexible walls or membrane. The fan may comprise a conduit for delivering air to the nozzle from an airflow generator, and the axial perturbation device may vary a flow rate of air in the conduit, thereby to perturb the velocity of the airflow expelled from the nozzle in the axial direction.

Optionally, the axial perturbation device may cause the air outlet to move in the axial direction at the first frequency, for example by moving at least a part of the nozzle back and forth in the axial direction, or it may comprise an arrangement for morphing a shape of the nozzle, such as for varying a diameter of the nozzle at the first frequency.

Optionally, the velocity perturbation applied by the axial perturbation device has a peak-to-peak amplitude of greater than 1% of the velocity of the airflow at the air outlet.

The velocity perturbation may have a peak-to-peak amplitude of between 1% and 50%, or equal to or greater than 50%. The velocity perturbation may have a peak-to-peak amplitude of around 25%. For example, the mean exit velocity at the air outlet may be between 2.5 metres per second (m/s) and 3.5 m/s, such as 3 m/s and the peak-to-peak amplitude of the axial perturbation may be between 0.03 m/s and 1.5 m/s, such as 0.75 m/s. Increasing the amplitude of the perturbation may increase a strength of the vortices, which may increase the effect of the jet spreading, splitting and/or blooming, for instance by increasing a spreading or bifurcation angle of a spread or split jet.

Optionally, the airflow is expelled at a flow rate of between 10 l/s and 100 l/s.

Optionally, the air outlet has diameter of between 45 mm and 200 mm.

Optionally, the first frequency is less than 60 Hz.

In this way, jet splitting and/or spreading may be obtained at first and/or second frequencies that are low in the audible range. The first and second frequencies may be sub-audible, such as less than 30 Hz, less than 25 Hz, or less than 20 Hz. The first frequency may be between 10 Hz and 30 Hz, and/or the second frequency may be between 5 Hz and 15 Hz.

That is, the nozzle diameter and air flow rate may be selected to provide the desired functionality at sub-audible perturbation frequencies. This may reduce an acoustic signature of the fan, which may be particularly advantageous where the axial and/or radial perturbation device is an acoustic perturbation device.

Applying an axial velocity perturbation to the airflow may result in an increased entrainment of ambient air into the jet. A reduced entrainment of ambient air may be obtained by using a relatively large diameter nozzle. This may be beneficial when used, for example, with purified air. A reduced entrainment of ambient air may lead to a higher purity of air reaching a user. A larger diameter nozzle and/or a lower air flow rate may reduce the perturbation frequencies required to obtain jet splitting, spreading and/or blooming, thereby reducing an acoustic signature of the fan.

Optionally, the fan comprises a flow conditioning device for adjusting a velocity profile of the airflow delivered to and/or expelled from the nozzle.

The flow conditioning device may be to make the velocity profile of the airflow expelled from the nozzle more uniform, such as more axisymmetric and/or less turbulent. The flow conditioning device may reduce swirl in the flow. The fan may comprise a conduit for delivering airflow to the nozzle, for example from an airflow generator. The conduit may comprise a settling chamber, which may function as the flow conditioning device.

Alternatively, or in addition, the flow conditioning device may comprise a flow straightener in the conduit and/or the nozzle. The flow straightener may comprise a mesh, a screen, a honeycomb structure, or any other suitable flow straightener.

The flow conditioning device may improve the spreading, splitting and/or blooming functions of the fan, such as in any of the first to fourth modes of operation.

Optionally, the fan comprises a flow directional device for controlling a direction of the airflow expelled from the nozzle.

The flow directional device may be operable to control a direction of the airflow expelled from the nozzle. That is, the flow directional device may vary the axial direction of the jet expelled from the air outlet. The flow directional device may control a direction of a spread, split and/or blooming jet, such as in any of the first to fourth modes of operation. For example, a plane of a radially spread or bifurcated jet may be tilted in one or more different directions.

The fan may be operable in a fifth mode of operation, wherein the flow directional device continually and/or periodically varies the direction of the jet expelled from the nozzle, for instance to automatically direct a bifurcated or spread jet to different portions of a room, or in the direction of two or more users.

Optionally, the flow directional device comprises one or more guide vanes.

The guide vanes, or louvres, may be adjustable to adjust a direction of the airflow expelled from the nozzle. Alternatively, or in addition, the flow directional device may comprise a gimbal arrangement for gimballing at least a part of the nozzle to orientate the air outlet in different directions.

The fan may comprise a flow straightener, and an orientation of at least a part of the flow straightener may be varied to change the direction of the jet in any of the first to fifth modes of operation. That is, the flow directional device may comprise one or more adjustable flow straighteners.

Optionally, the fan is a room or desk fan.

The fan may be a fan heater, cooler, humidifier, dehumidifier and/or purifier. The fan may comprise an airflow generator for generating the airflow delivered to the nozzle. The airflow delivered to and/or expelled from the nozzle may comprise conditioned air from an air conditioning device, such as a device configured to heat, cool, purify, humidify, and/or de-humidify the air.

BRIEF DESCRIPTION OF THE DRAWINGS

Embodiments will now be described, by way of example only, with reference to the accompanying drawings, in which.

DETAILED DESCRIPTION

Details of methods and systems according to examples will become apparent from the following description, with reference to the Figures. In this description, for the purpose of explanation, numerous specific details of examples are set forth. Reference in the specification to 'the example' or similar language means that a particular feature, structure, or characteristic described in connection with the example is included in at least that one example, but not necessarily in other examples. It should further be noted that the examples illustrated in the figures are described in various different ways and are described schematically with certain features omitted and/or necessarily simplified for ease of explanation and understanding of the concepts underlying the example.

In the following description, examples are described in relation to a room or desk fan having a circular nozzle. It will be understood that the features and underlying concepts of the examples may be applied to other kinds of fan.

Figure 1:
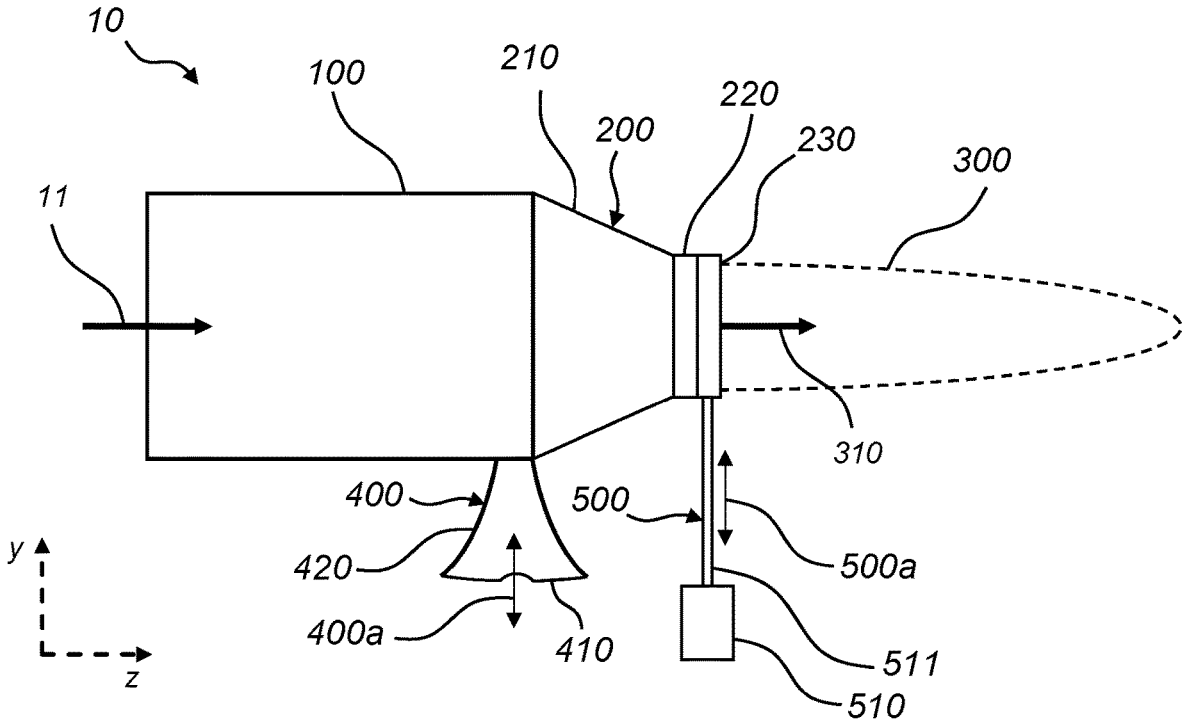
FIG. 1 is a side-on schematic diagram of a fan according to an example.

FIG. 1 shows a side-view of an example of a fan 10 comprising a conduit 100 and a nozzle 200, the nozzle comprising a converging portion 210 and an air outlet 230. The converging portion 210 converges from the conduit 100 to a nozzle outlet 220. The air outlet 230 is arranged adjacent to the nozzle outlet 220. In this way, air received by the nozzle 200 is compressed towards the air outlet 230 via the nozzle outlet 220, thereby increasing a velocity of the airflow. In other examples, the nozzle 200 is any other suitable shape, for example an expanding nozzle 200, or a straight nozzle 200, such as a constant diameter nozzle 200. The airflow is expelled through the air outlet 230 in an axial direction, indicated by the arrow 310 in FIG. 1, thereby to form a jet 300 of air, which is directed into a room or towards a user, for instance. The axial direction 310 is parallel to a 'z'-coordinate, as shown in FIG. 1. The 'x'- and 'y'-coordinates define a plane that is orthogonal to the z-coordinate. That is, the z-coordinate corresponds to an axial direction 310 and the x- and y-coordinates correspond to radial directions, perpendicular to the axial direction 310 in this example.

Figure 2:
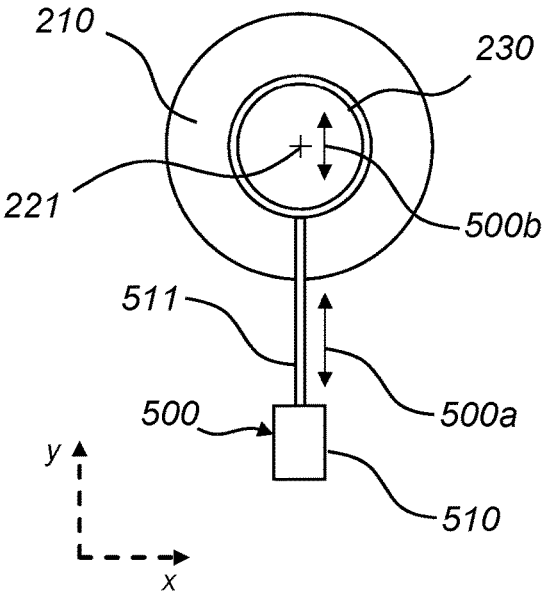
FIG. 2 is a frontal schematic diagram of the fan of FIG. 1.

FIG. 2 shows the fan 10 when viewed along an axis parallel with the axial direction 310. The fan comprises a circular air outlet 230, though other suitable shapes may be employed, such as an elongate or square air outlet 230.

In the present example, the air outlet 230 abuts the nozzle outlet 220, as shown in FIG. 1, and is movable relative to the nozzle outlet 220. A suitable seal is formed between the nozzle outlet 220 and the air outlet 230, so that air flows from the nozzle outlet 220 to the air outlet 230. In some examples, the air outlet 230 is spaced from the nozzle outlet 220 and a seal (not shown) is provided between the air outlet 230 and the nozzle outlet 220. In some examples, the nozzle outlet 220 is the air outlet 230. In some examples, the seal and/or the nozzle 200 is constructed at least in part from flexible or otherwise deformable material to permit movement of the air outlet 230 relative to the nozzle 230 and/or the conduit 100.

The conduit 100 receives air at one end thereof, as indicated by the arrow 11 in FIG. 1. The air is received by the conduit 100 from an airflow generator (not shown). Any suitable airflow generator may be used to supply air to the conduit 100, the nozzle 200 and/or the air outlet 230. For instance, the airflow generator may comprise an impeller in an axial, centrifugal or cross-flow arrangement. In some examples, the impeller is driven by an electrically commutated (EC) motor, though in other examples this need not be the case.

In some examples, the air is supplied to the conduit 100 and/or the nozzle 200, via an air conditioning device for conditioning the air. The air conditioning device is any of a heater, cooler, purifier, humidifier, or any other air conditioning device. That is, in some examples, the air received by, and expelled from, the air outlet 230 is heated, cooled, purified, humidified, or otherwise conditioned. In some examples, the fan 10 comprises the airflow generator and/or the air conditioning device. In other examples, the airflow generator and/or air conditioning device is located away from the fan 10 and is configured to supply conditioned or unconditioned air to the fan 10.

In the present example, the conduit 100 is straight. In some examples, the conduit comprises a bend so that the airflow from the airflow generator changes direction in the bend. In some examples, the conduit comprises multiple portions, including combinations of straight and bent portions. In some examples, the conduit comprises, and/or portions of the conduit are interspersed between, air conditioning devices as described hereinbefore and/or flow conditioning devices as will be described hereinafter with reference to FIGS. 7A to 7D. In some examples, the conduit 100 is not present and the air is received by the nozzle directly from the airflow generator.

With reference to FIGS. 1 and 2, the fan comprises an axial perturbation device 400 and a radial perturbation device 500. In some examples, the radial perturbation device 500 is not present and the fan comprises only the axial perturbation device 400. The axial perturbation device is for applying a velocity perturbation at an axial perturbation frequency to the airflow in the axial direction 300. In the present example, the axial perturbation device is an acoustic perturbation device comprising a loudspeaker 410, such as a subwoofer. The loudspeaker 410 is coupled to the conduit 100 by a passage 420. That is, air on one side of the loudspeaker 410 is in fluid communication with the airflow in the conduit 100 via the passage 420. The loudspeaker oscillates at the axial perturbation frequency in a direction indicated by the arrow 400*a* in FIG. 1. This imposes sinusoidal velocity fluctuations onto the airflow in the conduit 100 and thus onto the airflow expelled through the air outlet 230. The mean flow rate and velocity out of the nozzle is unaffected. The effect of applying an axial velocity perturbation is discussed below with reference to FIG. 5.

In some examples, the axial perturbation device 400 is coupled to the nozzle 200, such as coupled to the converging portion 210, the nozzle outlet 220, or the air outlet 230. In some examples, the axial perturbation device 400 is comprised in the conduit 100 or nozzle 200. In some examples, the axial perturbation device 400 comprises a mechanical or electromechanical part such as a movable paddle, flow restrictor, or flexible wall or membrane within the conduit 100, for instance for varying the flow rate of air in the conduit 100. In some examples, the axial perturbation device 400 comprises an actuator (not shown) for moving the nozzle 200 and/or the air outlet 230 back and forth in the axial direction 310, for instance to impart axial velocity fluctuations directly into the airflow expelled from the air outlet 230. In some examples, the axial perturbation device 400 comprises an arrangement for morphing a shape of the nozzle 200 and/or air outlet 230, such as for varying a diameter of the air outlet 230 at the axial perturbation frequency.

The radial perturbation device 500 comprises a radial actuator 510, such as a piston 510 comprising a connecting arm 511 connected to the air outlet 230. The air outlet 230 here is a ring comprising a circular opening, and the connecting arm 511 is connected to the ring. The radial actuator 510 is configured to oscillate at a radial perturbation frequency, causing the connecting arm 511 to move in a direction illustrated by the arrow labelled 500*a* in FIG. 2, which here is aligned with the y-coordinate. This causes the air outlet 200 to oscillate, at the radial perturbation frequency, in the direction shown by the arrow labelled 500*b* in FIG. 2, which is also aligned with the y-coordinate. This is to impart a radial velocity fluctuation at the radial perturbation frequency to the airflow expelled from the air outlet 230.

The radial actuator 510 is any suitable kind of actuator, such as a mechanical, electromechanical, hydraulic or pneumatic actuator. In the present example, the radial actuator 510 comprises a loudspeaker configured to move the connecting arm 511. In some examples, the radial actuator 510 comprises any other suitable electronic mover, such as a piezoelectric actuator or servo-controlled motor arrangement.

In some examples, the radial perturbation device 500 is configured to move the air outlet 230 in more than one radial direction. In some examples, the radial perturbation device 500 comprises more than one radial actuator 510 connected to the air outlet 230, or other part of the nozzle 200, to cause the air outlet 230 to move in a respective more than one radial direction. That is, in some examples, the radial perturbation device 500 comprises more than one radial actuator 510 circumferentially spaced around, and orientated at different angles to, the air outlet 230. In some examples, moving the air outlet in more than one radial direction comprises moving the air outlet in a circular motion.

Figure 3:
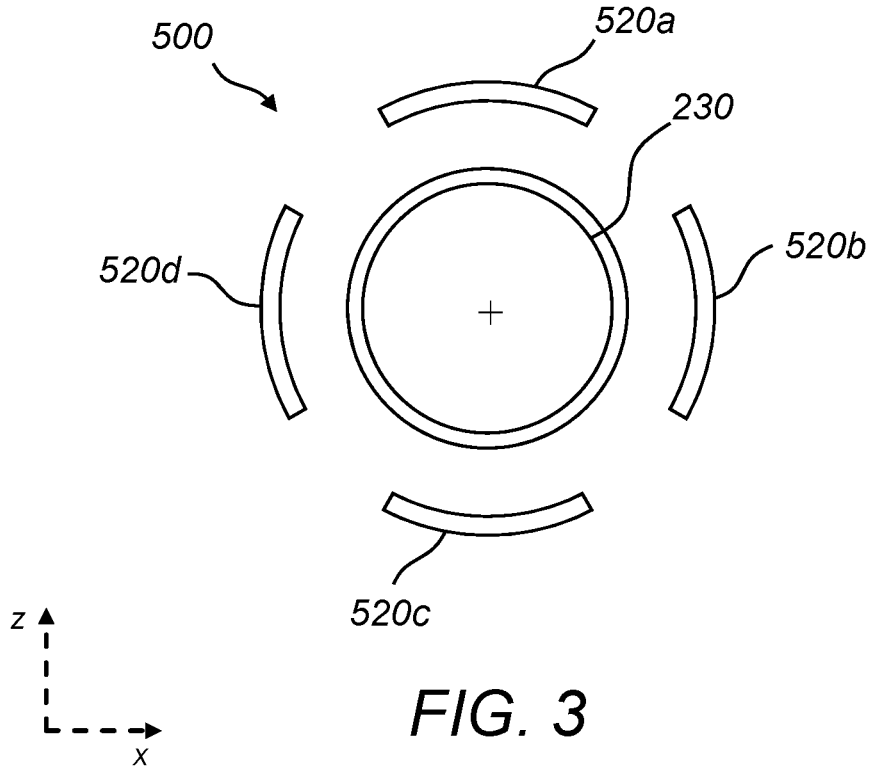
FIG. 3 is a frontal schematic diagram of an alternative radial perturbation device of the fan of FIG. 1.

FIG. 3 shows such an arrangement comprising a plurality of radial actuators 520*a*-520*d* circumferentially spaced around the air outlet. In this example, the radial actuators 520*a*-520*d* are electromagnetic actuators 520*a*-520*d* comprising at least one electromagnet switchable to generate an electromagnetic field. The air outlet 230 here comprises ferrous material and is attracted to the electromagnets 520*a*-520*d* when the electromagnets are operated to generate an electromagnetic field. In this way, the air outlet 230 can be moved in at least one radial direction, such as in the x- or y-directions, by sequentially activating opposing electromagnets. The air outlet 230 can be moved in a circular motion by activating the magnets circumferentially in sequence, for example.

In some examples, the radial actuators 520*a*-520*d* of FIG. 3 are any suitable actuators such as those described hereinbefore with reference to FIGS. 1 and 2. In other examples, the radial perturbation device is an acoustic perturbation device comprising, for example, one or more loudspeakers oriented towards the air outlet in the one or more radial directions. That is, in some examples, the radial actuator 510 of FIGS. 1 and 2 and/or the radial actuators 520*a*-520*d* of FIG. 3 are instead acoustic perturbation devices. In this way, the radial perturbation device 500 can be configured to impart sinusoidal radial velocity fluctuations to the airflow expelled from the nozzle without physically moving the air outlet.

Figure 4:
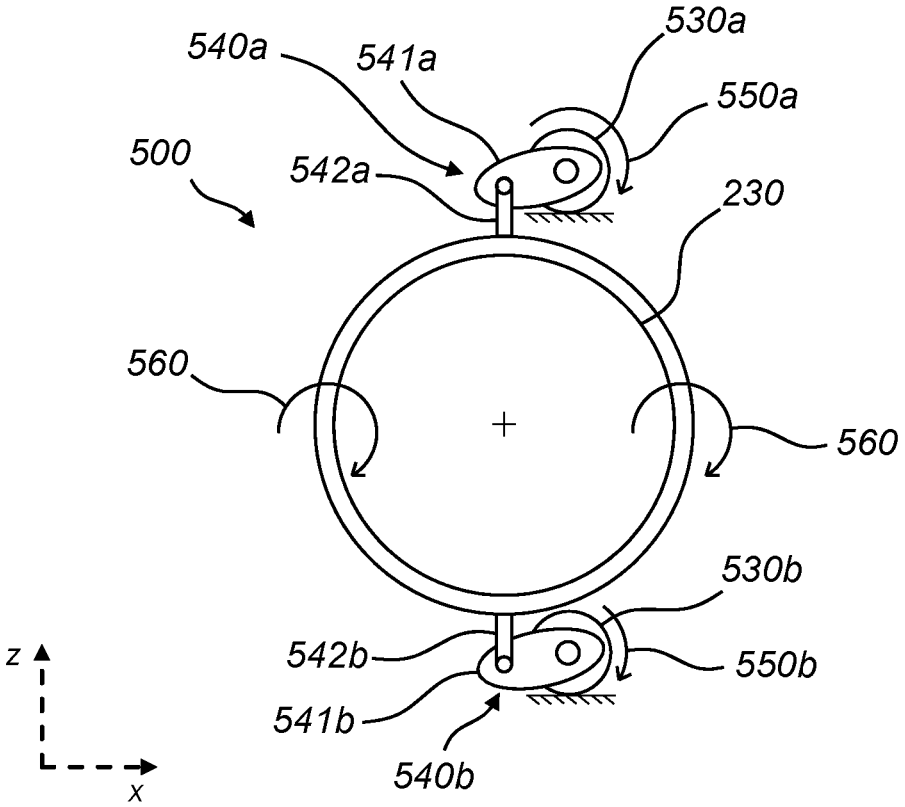
FIG. 4 is a frontal schematic diagram of a further alternative radial perturbation device of the fan of FIG. 1.

FIG. 4 shows an example alternative arrangement for causing the air outlet 230 to move in a circular motion. In this example, the radial actuators 530*a*, 530*b* are motors 530*a*, 530*b* coupled to the air outlet 230 via respective linkages 540*a* 540*b*. Each linkage comprises first and second connectors 541*a*, 542*a*, 541*b*, 542*b*. Referring to one of the motors 530*a*, the second connector 542*a* is eccentrically coupled to a shaft of the motor 530*a* via the first connector 541*a*. That is, the second connector 542*a* is off-centre from a shaft of the motor 530*a*. In this way, operation of the motors 530*a*, 530*b* in the direction illustrated by the arrows labelled 550*a*, 550*b* in FIG. 4 causes the air outlet 230 to move in a circular motion in the x-y plane, as illustrated by the arrows labelled 560 in FIG. 4. The motors 530*a* 530*b* are any suitable motors known to the skilled reader, such as servo motors. In some examples there is any number of motors 530*a*, 530*b*, such as only one motor or more than two motors. In other examples, the air outlet 230 is moved in the one or more radial directions, such as in a circular motion, in any suitable way, such as by using any other suitable linkage and/or gearing system, for instance by using a sun gear or a cam system.

We now discuss the operation of the fan 10 with reference to FIGS. 5*a* to 7D.

Low Entrainment Mode

Figure 6A:
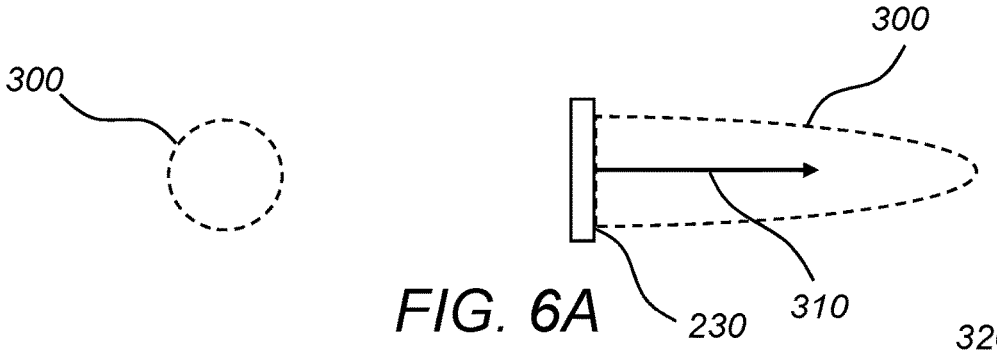
FIG. 6A is a schematic illustration of a jet expelled from the fan of FIG. 1 when the fan is operated in a low entrainment mode of operation.
Figure 6B:
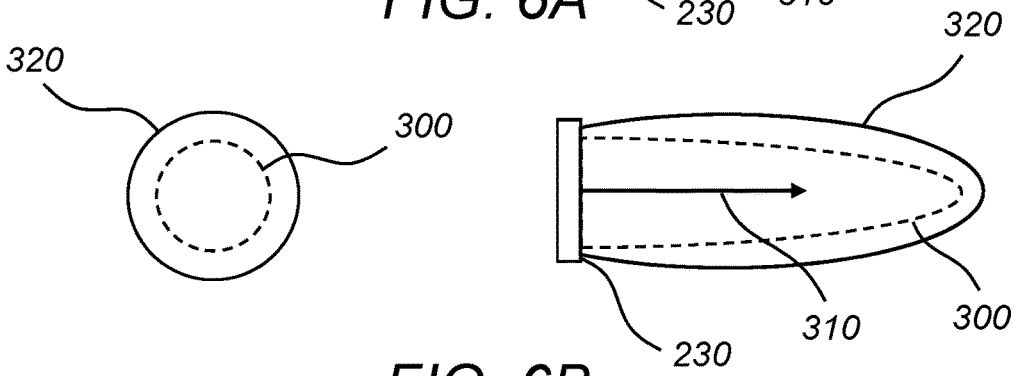
FIG. 6B is a schematic illustration of a wide jet expelled from the fan of FIG. 1 when the fan is operated in a medium entrainment mode of operation.

In the present example, the fan 10 is operable in a low entrainment mode of operation, wherein the axial and radial perturbation devices 400, 500 are inactive and the entrainment of ambient air into the jet 300 is relatively low. That is, in the low entrainment mode of operation, the airflow expelled from the nozzle 200, though the air outlet 230, is unperturbed by the axial and radial perturbation devices. FIG. 6A shows a schematic illustration of the jet 300 expelled from through the air outlet 230. The jet 300 has a potential core (not shown) that extends downstream of the air outlet 230, for example between 4 and 7 times, such as between 5 and 6 times the diameter of air outlet 230 downstream of the air outlet 230. The potential core is mostly comprised of air expelled from the fan 10, such as conditioned air as described hereinbefore. Outside of the potential core, ambient air surrounding the jet 300 begins to mix with the air in the jet 300. Therefore, in some examples, it is desirable to increase a diameter of the air outlet 230 in order to minimise entrainment and increase a length of the potential core, thereby to project conditioned air further downstream of the nozzle 200 into a room and/or towards a user.

Medium Entrainment Mode

Figure 5A:
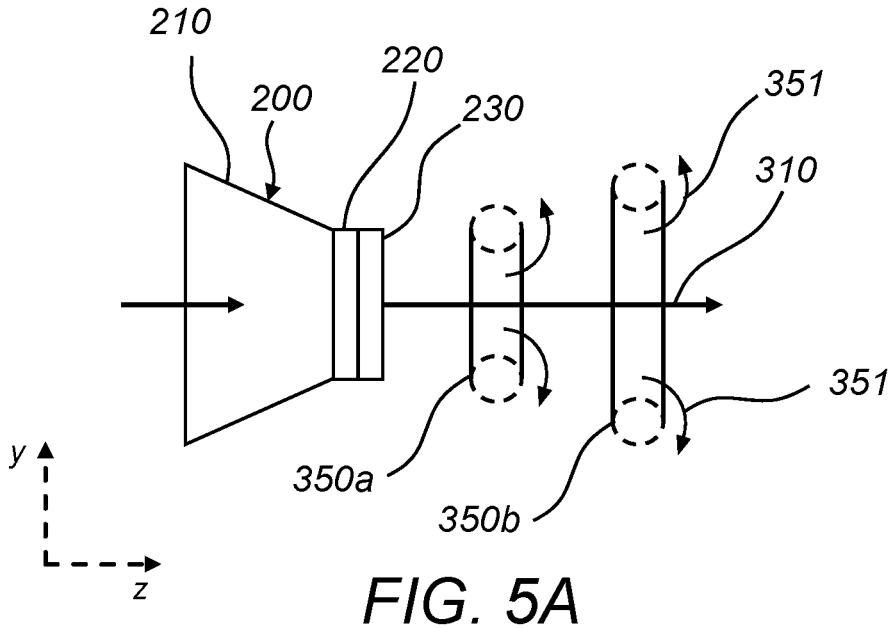
FIG. 5A is a side-on schematic diagram showing toroidal vortices generated by operation of an axial perturbation device of the fan of FIG. 1.

The fan 10 of the present example is operable in a medium entrainment mode of operation, wherein the axial perturbation device 400 is active and the radial perturbation device 500 is inactive. In the medium entrainment mode, the axial perturbation device 400 is configured to impart a velocity perturbation, or fluctuation, to the airflow expelled from the air outlet 230 at the axial perturbation frequency, as described hereinbefore. The axial perturbation frequency is selected to correspond to a natural frequency of toroidal vortex modes in the jet. In this way, as shown in FIG. 5A, the axial perturbation device 400 causes a series of toroidal vortices 350*a*, 350*b* to be generated at the air outlet at the axial perturbation frequency. The toroidal vortices 350*a*, 350*b* are torus-shaped vortices that travel in and have a central axis (not shown) aligned with the axial direction 310. Each toroidal vortex 350*a*, 350*b* is substantially circular when viewed along the axial direction 310, for example due to the shape of the air outlet 230. FIG. 5A shows a cross-section through the toroidal vortices 350*a*, 350*b* in the y-z plane. Airflow within the toroidal vortex moves faster than airflow outside of the toroidal vortex. In this way, a local airflow circulates around an imaginary axis that forms a closed loop around the central axis, as illustrated by the arrows labelled 351 in FIG. 5A. Each toroidal vortex 350*a*, 350*b* has a diameter on the scale of the diameter of the air outlet 230. In some examples, the diameter of each toroidal vortex 350*a*, 350*b* increases as the vortex 350*a*, 350*b* travels downstream from the air outlet 230.

The local circulation 351 causes the air in the jet 300 to be spread in all radial directions. That is, the toroidal vortices 350*a*, 350*b* entrain the airflow in the jet 300 to increase a diameter of the jet 300 downstream from the nozzle 200. This is illustrated schematically in FIG. 6B. Here, the modified jet is shown by a solid line 320, while the jet 300 generated in the low-entrainment mode of operation is shown as a dashed line 300. In the medium-entrainment mode of operation, the toroidal vortices 350*a*, 350*b* generally increase the entrainment of ambient air into the jet 320. This results in a shorter potential core. The medium-entrainment mode operation can be used in examples to increase an area of the airflow projected into a room or towards a user, for instance to cover more of a user's face or body.

Jet Spreading Mode

Figure 5B:
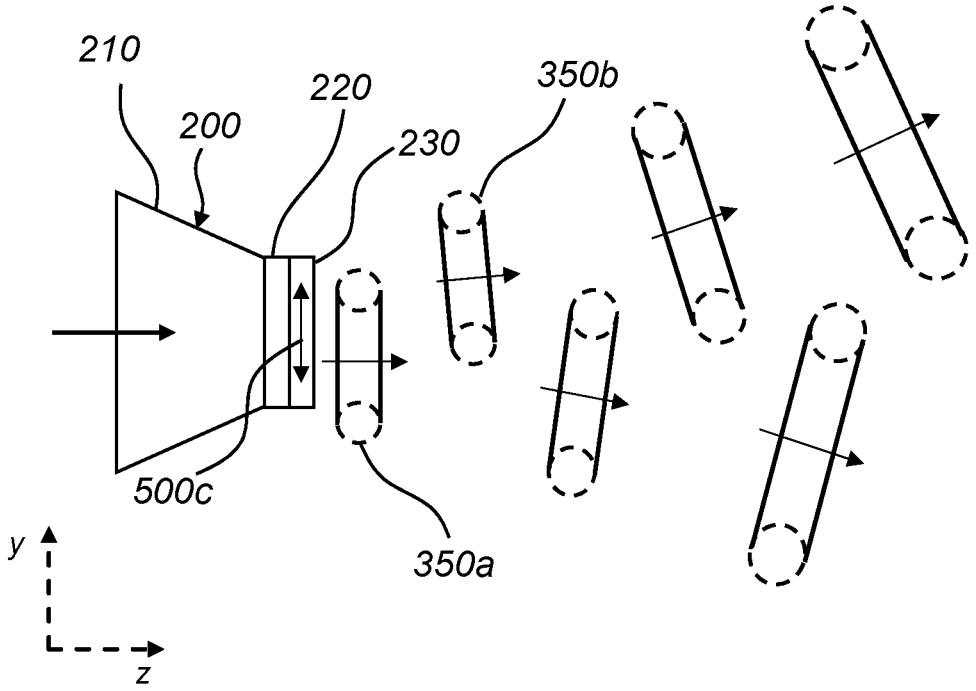
FIG. 5B is a side-on schematic diagram showing a modification of the jet expelled from the fan of FIG. 1 by operation of a radial perturbation device.

The fan 10 of the illustrated example may be operable in a jet spreading mode of operation. In the jet spreading mode of operation, both the axial and radial perturbation devices 400, 500 are active. That is, as described hereinbefore, the axial perturbation device applies an axial velocity perturbation at an axial perturbation frequency to the airflow expelled from the air outlet 230, while the radial perturbation device applies one or more radial velocity perturbations at the radial perturbation frequency to the airflow expelled from the air outlet 230. As shown in FIG. 5B, this is to cause successive toroidal vortices 350*a*, 350*b* in the series of toroidal vortices generated by operation of the axial perturbation device 400 to be radially displaced relative to one another. In the illustrated example, a forcing ratio of the axial perturbation frequency to the radial perturbation frequency is 2, and the air outlet 230 is oscillated back and forth in the y-direction as shown by the arrow labelled 500*c* in FIG. 5B. That is, the axial perturbation frequency is twice the radial perturbation frequency. In other examples, the air outlet 230 is moved in a circular motion as described hereinbefore at the radial perturbation frequency, which is half the axial perturbation frequency.

Operating the axial and radial perturbation devices at a forcing ratio of 2 causes successive toroidal vortices 350*a*, 350*b* to be generated at opposite sides of an axis aligned with the axial direction 310. This causes the vortices 350*a*, 350*b* to be radially staggered downstream of the air outlet 230, as shown in FIG. 5B. The successive vortices 350*a*, 350*b* interact with one another to cause the central axis of each vortex to tilt away from the axial direction. In this way, successively generated toroidal vortices 350*a*, 350*b* travel in opposing directions oblique to the axial direction 310. The toroidal vortices 350*a*, 350*b* entrain airflow in the jet 300 to pull the jet 300 to either side, thereby to cause the jet 300 to spread in the y-direction. In some examples, the jet 300 bifurcates into two distinct jets 330*a*, 330*b* as illustrated in the schematic diagram of FIG. 6C.

In the illustrated example, the airflow in the jets 330*a*, 330*b* is projected in the first and second bifurcation directions 331*a*, 331*b*, which diverge from each other at a bifurcation angle, α. That is, the jet is spread 300 in a bifurcation plane orientated parallel to the axial direction 310, and parallel to the first and second bifurcation directions 331*a*, 331*b*. The angle, α, can be increased by increasing an amplitude of the radial and/or axial perturbations. Increasing the axial and/or radial perturbation amplitude can increase the jet intensity, leading to well-defined bifurcated jets 330*a*, 330*b*. Selecting a ratio of three causes a trifurcation, or spreading of the jet 300 in three radial directions. For example, when the air outlet 230 is moved in a circular motion by the radial perturbation device 500 at a forcing ratio of 3, successive toroidal vortices 350*a*, 350*b* are shed at three equidistant locations around a circle traced by a centre of the air outlet 230 when viewed along the axial direction 310. This causes a helical spread of toroidal vortices 350*a*, 350*b* downstream from the air outlet 230, and causes the jet 300 to spread in three directions (not shown). In other words, in the jet spreading mode of operation, the axial perturbation frequency is an integer multiple of the radial perturbation frequency, such as 2, 3 or no more than 4 times the radial perturbation frequency to cause spreading or splitting of the jet 330*a*, 330*b* in one or more radial directions.

Diffusive Mode

In the present example, the fan may be operable in a diffusive mode of operation wherein both the axial and radial perturbation devices 400, 500 are active. In this mode of operation, the air outlet 230 is moved in a circular motion as described hereinbefore, though in other examples the air outlet 230 is moved in plural other radial directions. In the diffusive mode of operation, the axial perturbation frequency is a non-integer multiple of the radial perturbation frequency. That is, the forcing ratio is a non-integer, such as a number between 1 and 2, between 2 and 3, or between 3 and 4. In this way, successively generated toroidal vortices 350*a*, 350*b* are displaced in an irregular pattern around an axis aligned with the axial direction 310. That is, one vortex 350*a* may not exactly follow another vortex 350*b* generated previously.

Figure 6C:
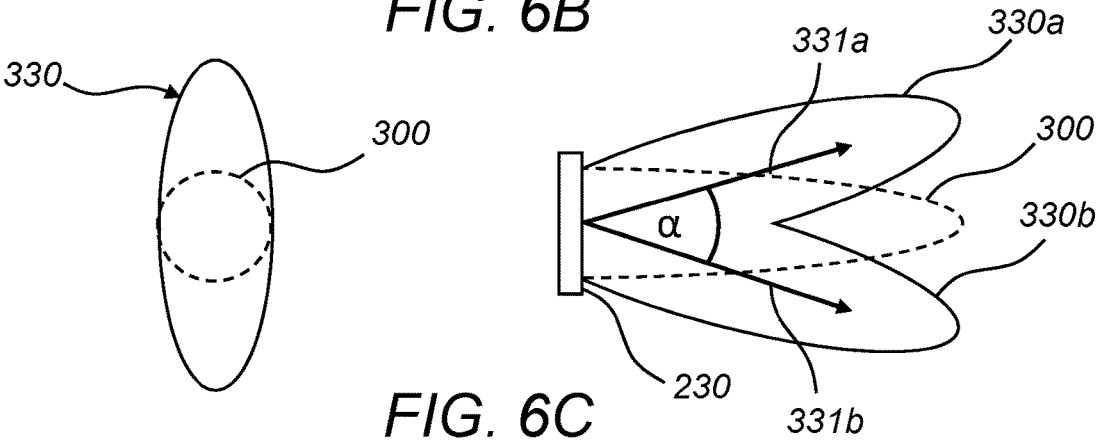
FIG. 6C is a schematic illustration of a bifurcated jet expelled from the fan of FIG. 1 in a jet spreading mode of operation.
Figure 6D:
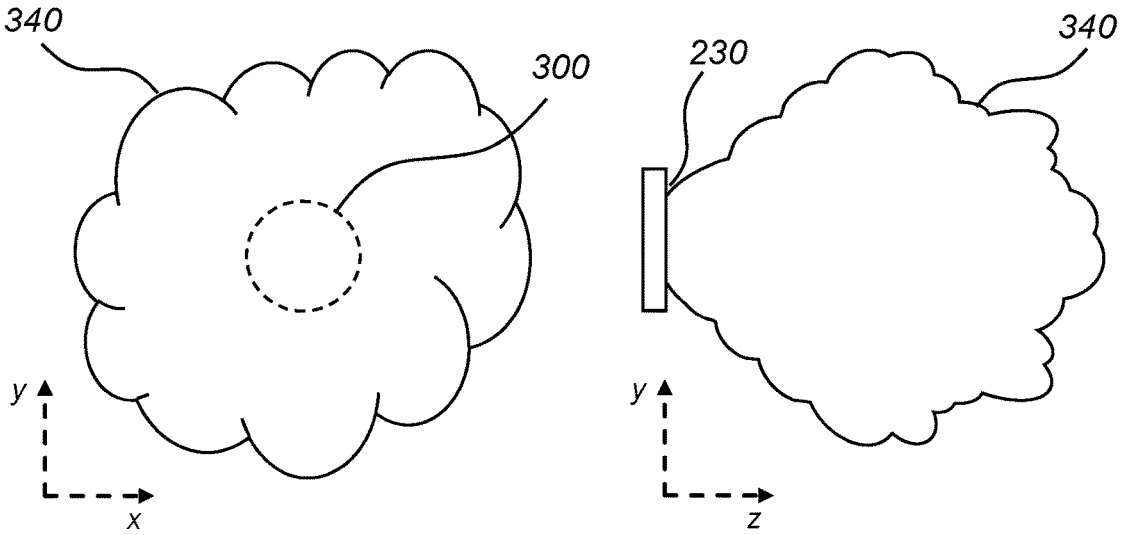
FIG. 6D is a schematic illustration of a diffuse jet expelled from the fan of FIG. 1 in a diffusive mode of operation.

In the diffusive mode of operation, the forcing ratio is suitably distant from an integer, such as greater than 0.2 or 0.3 units away from an integer, so that the toroidal vortices 350*a*, 350*b* interact to spread the jet in multiple radial directions, which may be arbitrary radial directions. This increases entrainment of ambient air into the jet 300 and causes the jet to become a diffuse jet 340 as illustrated in FIG. 6D. This may be referred to herein as a blooming jet 340. In some examples, the blooming jet 340, having high levels of entrainment, better mixes conditioned air expelled from the fan 10 with ambient air in a room, for instance. This may be to better heat, cool, purify or otherwise condition air in a whole room.

Precession Mode

In some examples, the fan 10 is operated in a precession mode of operation. Here, the axial and radial perturbations devices 400, 500 are operated using a non-integer forcing ratio, as in the blooming mode of operation, wherein the forcing ratio is sufficiently close to an integer such that successively generated toroidal vortices 350*a*, 350*b* closely (but not exactly) follow a path of a previously generated toroidal vortex 350*a*, 350*b*. In some examples, the forcing ratio is within 0.2 or 0.1 units of an integer. In this way, the jet 300 is caused to bifurcate or spread in one or more radial directions 330*a*, 330*b* as illustrated in FIG. 6C. The spread or bifurcated jet 330*a*, 330*b* precesses around an axis aligned with the axial direction 310.

Flow Conditioning and Direction

Figure 7A:
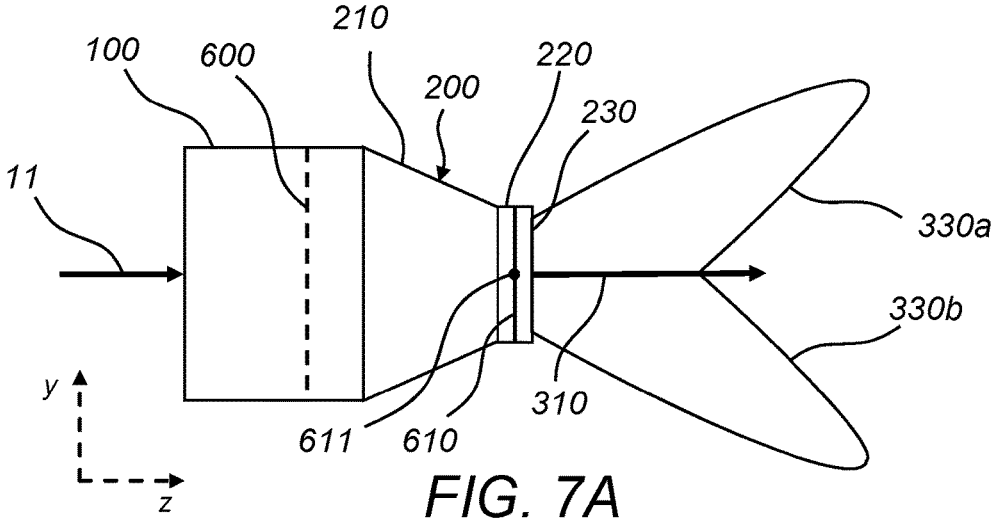
FIG. 7A is a side-view schematic diagram of the fan of FIG. 1 in a jet spreading mode of operation, showing an example flow conditioning and flow directional device.
Figure 7B:
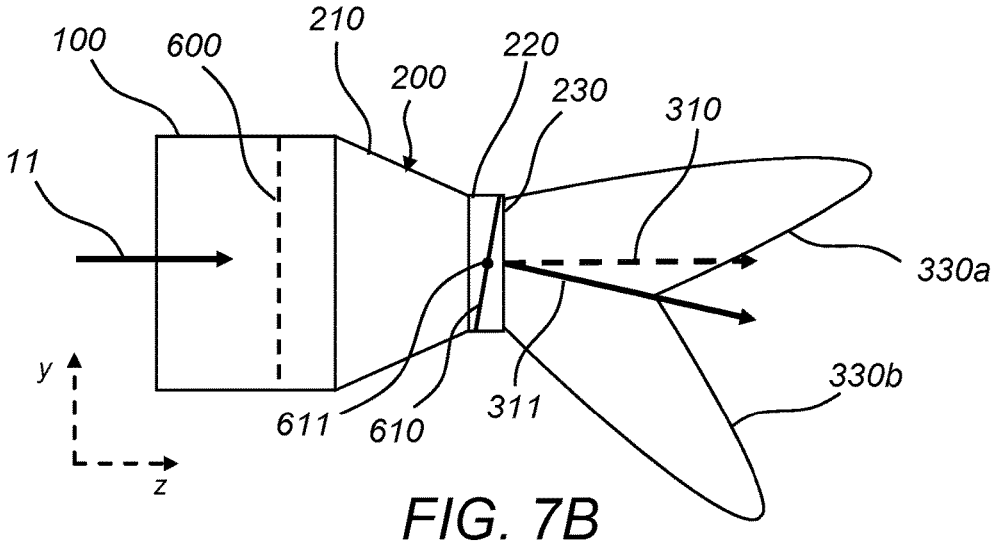
FIG. 7B is a schematic diagram of the fan of FIG. 7A showing an illustration of a directed bifurcated jet resulting from operation of the flow directional device.

FIG. 7A shows an example of the Fan 10 of FIG. 1 comprising a flow conditioning device 600 for adjusting a velocity profile of the airflow delivered to the nozzle 200. In the present example, the flow conditioning device 600 is a flow straightener 600 for making the velocity profile more uniform, such as more axisymmetric and/or less turbulent. A more uniform velocity profile is desirable to improve the formation of the toroidal vortices 350*a*, 350*b*, and thereby to improve the spreading, splitting and/or blooming functions of the fan 10 as described hereinbefore.

Figure 7C:
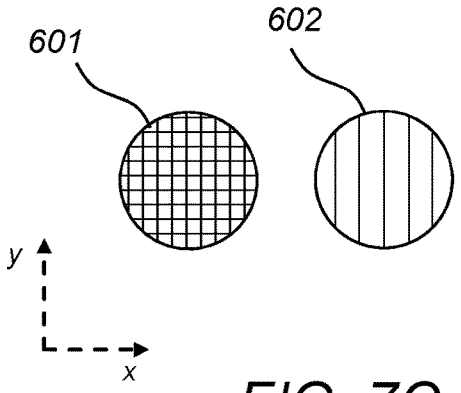
FIG. 7C is a frontal schematic diagram of example cross-sections of the flow conditioning or flow directional device of FIGS. 7A and/or 7B.

The flow straightener 600 of the present example is located in the conduit 100. In other examples, the flow straightener 600 is disposed at any suitable location upstream from the air outlet 230. In some examples, the flow straighter 600 is located after a bent portion of the conduit 100, or between an airflow generator (not shown) and the air outlet 230. The flow straightener 600 has a profile suitable for straightening the flow. FIG. 7C shows a schematic illustration of two example profiles when viewed in the z-direction, such as a checked profile 601 and a vane profile 602, though other profiles are envisioned, such as a honeycomb or other hexagonally close-packed profile. In other examples, the flow conditioning device 600 instead, or in addition, comprises a settling chamber (not shown) in the conduit 100. The settling chamber comprises a relatively wide-diameter portion, and/or a relatively long portion in the direction of the air flow through the conduit 100 so that the velocity profile develops through the settling portion to become a more uniform velocity profile.

In some examples, the fan 10 comprises a flow directional device 610 that is operable to control a direction of airflow expelled from the nozzle. In the present example, the flow directional device 610 comprises a flow straightener 600 having any suitable flow straightening profile 601, 602 as described hereinbefore with reference to FIG. 7C. The flow directional device is pivotably mounted in the nozzle outlet 220, which here is also the air outlet 230, at a pivot point 611. In some examples, the flow directional device 610 is disposed in a separate air outlet 230, such as described hereinbefore.

Operation of the flow directional device 610 comprises pivoting the flow directional device 610 around the pivot point 610 to cause the flow straightening profile 601, 602 to be orientated in different direction. This is to vary the axial direction 310 of the jet 300 expelled from the air outlet. Thus, the flow directional device 610 may function both to straighten the flow through the air outlet 230, providing the benefits described hereinbefore, and also to direct a jet 300 expelled from the air outlet 230. In various examples, the flow directional device 610 is operable to control a direction of a low entrainment jet 300 in the low entrainment mode, a medium-entrainment jet 310 in the medium-entrainment mode, a bifurcated or spread jet 330*a*, 330*b* in the bifurcation mode, a diffuse or blooming jet 340 in the diffusive mode, and/or a precessing jet 330*a*, 330*b* in the precession mode. For example, a plane of a radially spread or bifurcated jet 330*a*, 330*b* may be tilted in one or more different directions.

In some examples, the fan 10 is operable in a flow directional mode of operation, wherein the flow directional device 610 continually and/or periodically varies the direction of the jet 300 expellable from the nozzle 200 in any one of the hereinbefore described modes of operation. In some examples, this is to automatically, or manually on request of a user, to direct a bifurcated or spread jet to different portions of a room, or in the direction of one or more users.

Figure 7D:
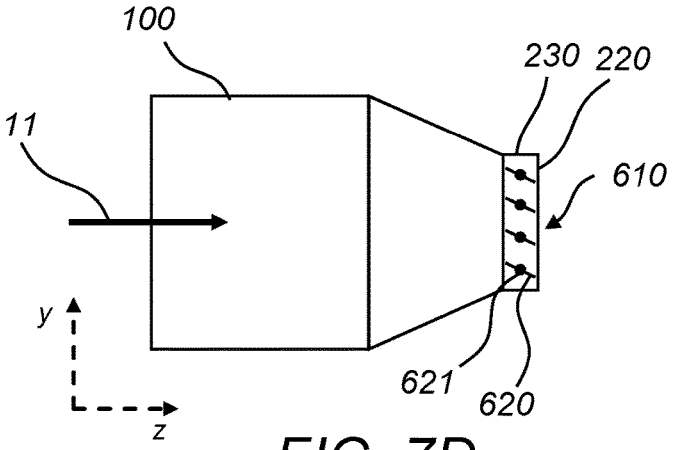
FIG. 7D is a schematic diagram of the fan of FIGS. 7A and 7B showing an alternative flow directional device.

In some examples, the flow directional device 610 my take any other suitable form. In some examples, the flow directional device 610 comprises a flow straightener 600 having a vane profile 602, or "louvre profile 602", and each of the guide vanes, or louvres, is individually pivoted around a respective axis. FIG. 7D shows a schematic diagram of such an example flow directional device 610 comprising individual guide vanes 620 and respective pivot points 621. It will be appreciated that moving the guide vanes 620 together has a similar effect in respect of directing a jet 300 as does moving the flow directional device 610 of FIGS. 7A and 7B around a single pivot point 611.

In other examples, the flow directional device 610 comprises a gimbal mechanism (not shown) for orientating the nozzle 200, nozzle outlet 220 and/or the air outlet 230 in different directions. In this case, the nozzle 200 may be constructed of flexible material to permit relative movement of the air outlet 230 with respect to the nozzle 200. In some examples, the entire nozzle 200 is movable. It will be understood that any other suitable mechanism for redirecting flow may be used to achieve the same effect.

In the present example, the fan 10 is a room or a desk fan. The flow rate of the airflow through the fan 10 is between 10 and 100 l/s, though any suitable flow rate is used in other examples. In some examples, a higher flow rate provides a more intense jet and/or a longer potential core, for instance for delivering a higher volume of conditioned air. In one example, the flow rate is between 10 l/s and 40 l/s, such as between 20 l/s and 30 l/s, such as around 25 l/s. A flow rate between 10 l/s and 40 l/s may provide a suitable flow rate while being more comfortable to a user, having a lower noise signature, permitting a smaller-diameter air outlet 230, and/or reducing a disturbance of ambient air, such as to reduce a disturbance of objects in a room or in the vicinity of a user, such as papers.

The axial perturbation frequency required to generate the toroidal vortices 350*a*, 350*b* is dependent on the flow rate of the airflow expelled through the air outlet 230 and the diameter of the air outlet 230. This relationship is represented using a so-called axial Strouhal number, defined as $St_a=f_0d/U_0$, where $f_0$ is the axial perturbation frequency, d is the diameter of the air outlet 230, and $U_0$ is the mean velocity of the airflow expelled through the air outlet 230. The velocity $U_0$ can be obtained from consideration of the flow rate and the cross-sectional area of the air outlet 230. In the present example, the axial Strouhal number is between 0.4 and 0.65, such as 0.5. In some examples, a Strouhal number between 0.4 and 0.55, such as between 0.45 and 0.5 causes the jet 300 to split into a well-defined bifurcated jet 330*a*, 330*b* in the bifurcation and precession modes of operation. In some examples, a Strouhal number between 0.55 and 0.65, such as 0.6, causes the jet 300 to spread, or to effectively be smeared, in one or more radial directions, or to form a less-well-defined bifurcated jet 330*a*, 330*b*. In some examples, the Strouhal number is variable, for example by varying the axial perturbation frequency, in order to provide user flexibility in the form of the jet 330*a*, 330*b* projected from the nozzle 200.

In the present example, the diameter of the air outlet 230 is selected to permit axial and radial perturbation frequencies that are less than 60 Hz for a given flow rate or velocity of the airflow through the air outlet 230. For example, the diameter may be selected, for a given air flow rate, to provide sub-audible axial perturbation frequencies, such as frequencies below 30 Hz. By way of example only, taking a Strouhal number of 0.4 and requiring an axial forcing frequency of less than 60 Hz, a minimum diameter of the air outlet 230, which may herein be referred to as a "nozzle diameter", is: 44 mm for a flow rate of 10 l/s; 60 mm for a flow rate of 25 l/s; 76 mm for a flow rate of 50 l/s; and 95 mm for a flow rate of 100 l/s.

A larger diameter air outlet 230 requires a lower axial perturbation frequency to generate suitable toroidal vortices 350*a*, 350*b* for a given Stouhal number. In this way, an upper limit of the diameter of the air outlet 230 is set by design constraints in some examples. In other examples, the axial perturbation frequency is larger than 10 Hz, so that the toroidal vortices 350*a*, 350*b* generated are less perceptible to a user. By way of further illustration, taking a Strouhal number of 0.65 and requiring an axial perturbation frequency of greater than 10 Hz, a maximum nozzle diameter is: 93 mm for a flow rate of 10 l/s; 127 mm for a flow rate of 25 l/s; 160 mm for a flow rate of 50 l/s; and 202 mm for a flow rate of 100 l/s. In this way, in some examples, the diameter of the air outlet 230 is between 45 and 200 mm, the axial perturbation frequency is between 10 Hz and 60 Hz, and the air flow rate is between 10 l/s and 100 l/s, so that the Strouhal number is between 0.4 and 0.65.

In some examples, the axial perturbation device 400 is configured to apply a velocity perturbation having a peak-to-peak (p-p) amplitude of greater than 1% of the velocity of the airflow at the air outlet 230. In some examples, the p-p velocity perturbation amplitude is between 1% and 50% of the velocity of the airflow at the air outlet 230, though in other examples the amplitude is 50% or greater than 50% of the velocity of the airflow at the air outlet 230. The velocity at the air outlet 230 may be an instantaneous velocity at a location in the air outlet 230, and/or a time-averaged and/or space-averaged velocity at the air outlet 230.

In some examples, the radial perturbation device 500 is configured to oscillate the air outlet with a p-p amplitude of greater than 1% of the nozzle diameter. In some examples the radial perturbation device 500 oscillates the air outlet at a p-p amplitude of between 1% and 10%. In other examples, the radial perturbation device 500 oscillates the air outlet 230 at a p-p amplitude of 10% or greater than 10% of the diameter of the air outlet 230.

In some examples, the fan 10 comprises a controller (not shown) for controlling operation of the fan 10. The controller controls any one or more of: the flow rate of air supplied to and/or expelled through the air outlet 230; the axial perturbation frequency; the axial perturbation amplitude; the radial perturbation frequency; and the radial perturbation amplitude. The controller controls the aforementioned parameters in response to user input, for example in response to a user selecting one of the modes described hereinbefore, and/or in response to a specific user request, for example a request for the fan 10 to generate a well-defined bifurcated jet at a high flow rate. In some examples, the fan 10 comprises physical controls for user input to the controller. In other examples, the controller receives commands or requests remotely from a user such as through a remote controller, or through a mobile application via an established communication network such as 3G, 4G, 5G, Wifi and/or Bluetooth connection. It will be understood that in examples the controller can be configured to provide any of the functionality and variability described hereinbefore in response to a user request.

It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the invention, which is defined in the accompanying claims.

The invention claimed is:

1. A fan comprising:

a nozzle having an air outlet through which an airflow is expelled in an axial direction;

a first perturbation device for applying a velocity perturbation at a first frequency to the airflow in the axial direction; and a second perturbation device for applying a velocity perturbation at a second frequency to the airflow in a plane orthogonal to the axial direction;

wherein the fan is operable:

in a first mode of operation in which the first perturbation device is inactive; and in a second mode of operation in which the first perturbation device is active and applies a velocity perturbation to the airflow at the first frequency; and wherein the first perturbation device superimposes continuous sinusoidal velocity fluctuations onto the air outlet.

2. The fan according to claim 1, wherein a ratio of the first frequency to the second frequency is greater than 1.

3. The fan according to claim 1, wherein a ratio of the first frequency to the second frequency is no greater than 4.

4. The fan according to claim 1, wherein the fan is operable:

in a first mode of operation in which the first and second perturbation devices are inactive;

in a second mode of operation in which the first perturbation device is active and applies a velocity perturbation to the airflow at the first frequency, and the second perturbation device is inactive; and in a third mode of operation in which the first perturbation device is active and applies a velocity perturbation to the airflow at the first frequency, and the second perturbation device is active and applies a velocity perturbation to the airflow at the second frequency.

5. The fan according to claim 4, wherein the fan is operable in a fourth mode of operation in which the second perturbation device applies a velocity perturbation to the airflow at a third frequency, and the third frequency is different to the second frequency.

6. The fan according to claim 5, wherein the second frequency and the third frequency are chosen such that the airflow expelled from the nozzle bifurcates in the third mode of operation and blooms in the fourth mode of operation.

7. The fan according to claim 5, wherein a ratio of the first frequency to the second frequency is 2.0, and a ratio of the first frequency to the third frequency is 2.5.

8. The fan according to claim 1, wherein the second perturbation device comprises an actuator configured to oscillate the air outlet at the second frequency.

9. The fan according to claim 8, wherein the actuator oscillates the air outlet with a peak-to-peak amplitude of greater than 1% of the nozzle diameter.

10. The fan according to claim 1, wherein the first perturbation device is an acoustic perturbation device.

11. The fan according to claim 1, wherein the velocity perturbation applied by the first perturbation device has a peak-to-peak amplitude of greater than 1% of the velocity of the airflow at the air outlet.

12. The fan according to claim 1, wherein the airflow is expelled at a flow rate of between 10 l/s and 100 l/s.

13. The fan according to claim 1, wherein the air outlet has diameter of between 45 mm and 200 mm.

14. The fan according to claim 1, wherein the first frequency is less than 60 Hz.

15. The fan according to claim 1, comprising a flow conditioning device for adjusting a velocity profile of the airflow delivered to and/or expelled from the nozzle.

16. The fan according to claim 1, comprising a flow directional device for controlling a direction of the airflow expelled from the nozzle.

17. The fan according to claim 16, wherein the flow directional device comprises one or more guide vanes.

18. The fan according to claim 1, wherein the fan is a room or desk fan.

* * * * *